United States Patent [19]

Wang

[11] 3,937,046

[45] Feb. 10, 1976

[54] MULTI-COMBINATION PUSH BUTTON LOCK

[76] Inventor: Hong Wen Wang, 2 Te Seng St., Kaohsiung, Taiwan, China /Taiwan

[22] Filed: Nov. 6, 1974

[21] Appl. No.: 521,469

[30] Foreign Application Priority Data

Mar. 25, 1974 China /Taiwan ..... 6310584

[52] U.S. Cl. ..... 70/81; 70/298; 70/315; 70/443; 292/175

[51] Int. Cl.[2] ..... E05B 37/16

[58] Field of Search ..... 70/81, 85, 86, 88, 129, 70/133, 150, 151 R, 151 A, 214, 287, 288, 298, 299, 315

[56] References Cited

UNITED STATES PATENTS

| | | | |
|---|---|---|---|
| 1,085,894 | 2/1914 | Eagle | 70/298 |
| 1,439,154 | 12/1922 | Decremer | 70/298 |
| 2,558,619 | 6/1951 | Lehman | 70/295 |
| 3,680,336 | 8/1972 | Schendel | 70/276 |

FOREIGN PATENTS OR APPLICATIONS

| | | | |
|---|---|---|---|
| 227,882 | 4/1969 | U.S.S.R. | 70/298 |
| 152,359 | 6/1904 | Germany | 70/298 |

*Primary Examiner*—Albert G. Craig, Jr.
*Attorney, Agent, or Firm*—McGlew and Tuttle

[57] ABSTRACT

The lock comprises a lock casing in which there is slidably mounted a lock plate movable between a projected locking position and a retracted unlocking position by a manually actuable operating member projecting from the front face of the casing. A plurality of push button assemblies are mounted in the casing, and each assembly includes a push button, an interlock block and a code changer, the push buttons projecting from the front of the casing and the code changers being accessible at the rear of the casing. By operating the push buttons to selected positions in accordance with the "combination", the interlock blocks are positioned to release the lock plate for operation by the actuating member. The code changers are operable to angularly adjust the interlock blocks to set the desired "combination".

9 Claims, 13 Drawing Figures

MULTI-COMBINATION PUSH BUTTON LOCK

FIELD AND BACKGROUND OF THE INVENTION

This invention relates to a multi-combination push button lock for locking drawers, safes, and the like, and comprising a number of push button assemblies whose push buttons project out of a front casing. By pushing down a certain number of the push buttons to selected depths in accordance with a preset combination code, the lock can be unlocked without the use of any key.

In the prior art, there are many kinds of locks, such as cylindrical locks and mortise-type locks, which require use of a key for operation, magnetic locks, which require a powerful magnetic bar to operate the same, or a digital combination cylindrical lock which has only a single combination code which is preset by the manufacturer. Once a key has been lost or counterfeited, or once the combination code of a digital combination lock is known by others, the locks became useless. Thus, these conventional locks mentioned above have the disadvantages of unreliability and inconvenience.

SUMMARY OF THE INVENTION

The objective of the invention is a multi-combination push button lock for locking drawers, safes, doors and the like. To this end, the lock comprises a number of push button assemblies for controlling the lock, with each assembly comprising a push button, an interlock block, a code changer and a small coil spring. The locking device comprises a lock plate with a return coil spring, and a manually actuable operating lever secured to and projecting vertically from the lock plate. The elements of the lock are mounted in a casing assembly including a front casing, a rear casing and a rear cover.

By pushing inwardly a certain number of push buttons to preset depths in accordance with a preset combination code, and moving the operating lever, the lock can be unlocked. Additionally, the combination code can be changed easily by turning at least one of the code changers to change the position of the associated interlock block.

An object of the invention is to provide a multi-combination push button lock comprising a number of push button assemblies, a locking device and a lock casing.

Another object of the invention is to provide such a multi-combination push button lock which can be unlocked by pushing a certain number of push buttons to any one of at least four selected depths in accordance with a preset combination code.

A further object of the invention is to provide such a multi-combination push button lock in which the combination code can be changed by turning at least one code changer, included in a push button assembly, to change the angular position of the associated interlock block of the push button assembly.

Yet another object of the invention is to provide a multi-combination push button lock, including a lock plate having plural arcuate notches on its side edges.

A further object of the invention is to provide a multi-combination push button lock including a number of interlock blocks in the form of cylinders each extending through an arcuate notch in the lock plate, and each having longitudinally and angularly spaced grooves or slots formed therein for allowing movement of the lock plate.

For an understanding of the principles of the invention, reference is made to the following description of typical embodiments thereof as illustrated in the accompanying drawings.

DESCRIPTION OF THE PREFERRED EMBODIMENTS

Figure 1:
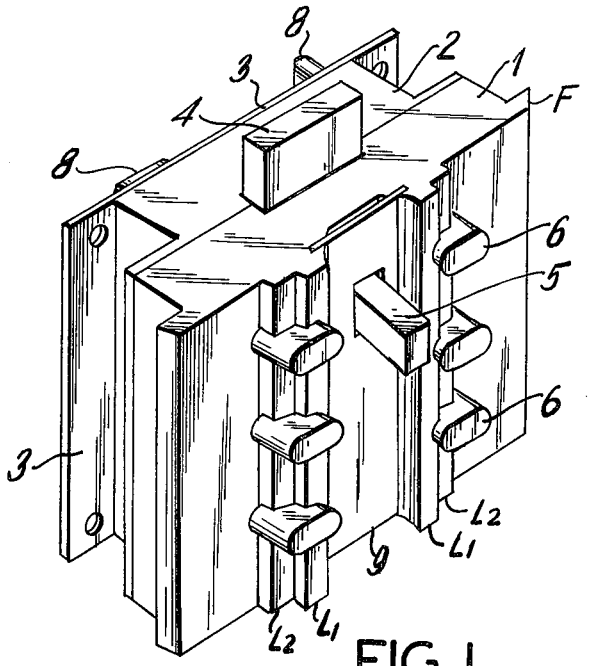
FIG. 1 is a perspective view of a multi-combination push button lock embodying the present invention and illustrated in its locking state.

Referring first to the embodiment of the invention illustrated in FIGS. 1 through 13, the lock casing assembly includes a front casing 1, a rear casing 2 connected to front casing 1 by screws S, and a rear cover 3 secured by screws to rear casing 2. A lock plate 4 is installed between the front and rear casings to move freely longitudinally of a slot defined conjointly by frontcasing 1 and rear casing 2. Lock plate 4 is operable by a manually actuable operating bar or lever secured to lock plate 4 to project vertically therefrom and through an elongated slot or aperture H in front casing 1. Push buttons 6 are mounted in respective bores $h_1$ in front casing 1 to project outwardly therefrom. In FIG. 4, reference character W denotes the material, such as wood, of drawers, safes or doors.

Figure 2:
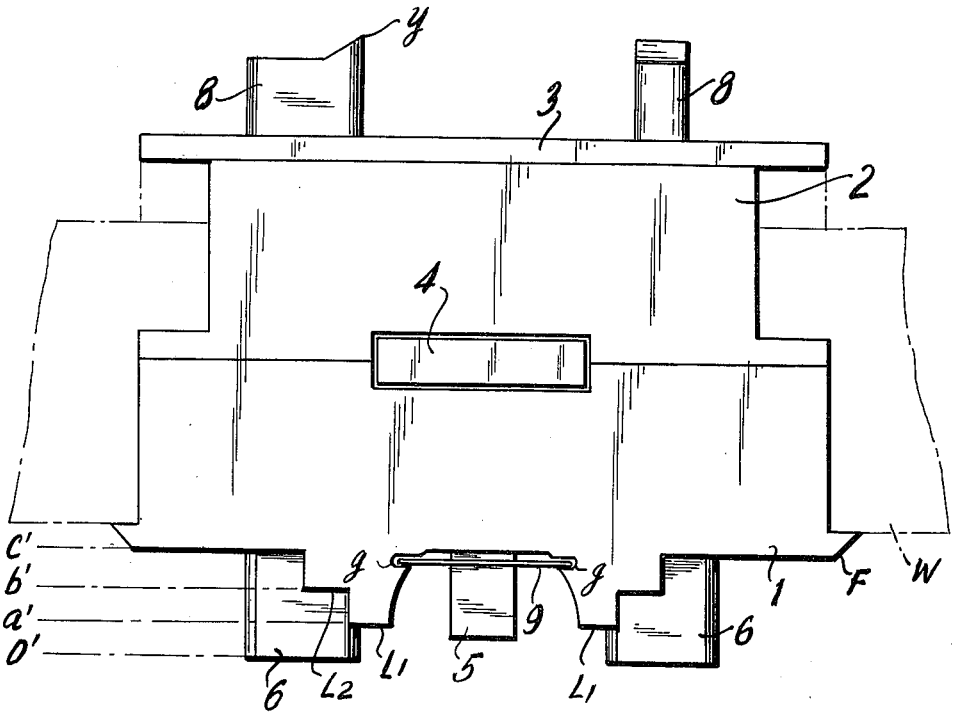
FIG. 2 is a top view corresponding to FIG. 1.

The several push button bores $h_1$ are arranged on opposite sides of slot H. In the illustrated embodiment, there are six push button bores, three on each side of slot H. As best seen in FIGS. 1 and 2, limiting guides, for depression of the push buttons 6, are formed by two lands or ribs $L_1$ and $L_2$ projecting from the surface of front casing 1. Land $L_1$ serves as a limit for a shallow push, land $L_2$ serves as a limit for a medium push, and the surface of front casing 1 serves as a limit for a deep push. As best seen in FIG. 4, two grooves *g* are formed at the inner corners of the junction of lands $L_1$ and the front surface of front casing 1, so that a thin plate 9, inserted into the grooves *g*, covers the longitudinal slot H. Flanges F are formed at the opposite sides of front casing 1 and serve as stops for mounting the lock on the frame of a door, a safe or a drawer on which the lock is to be installed.

Figure 5:
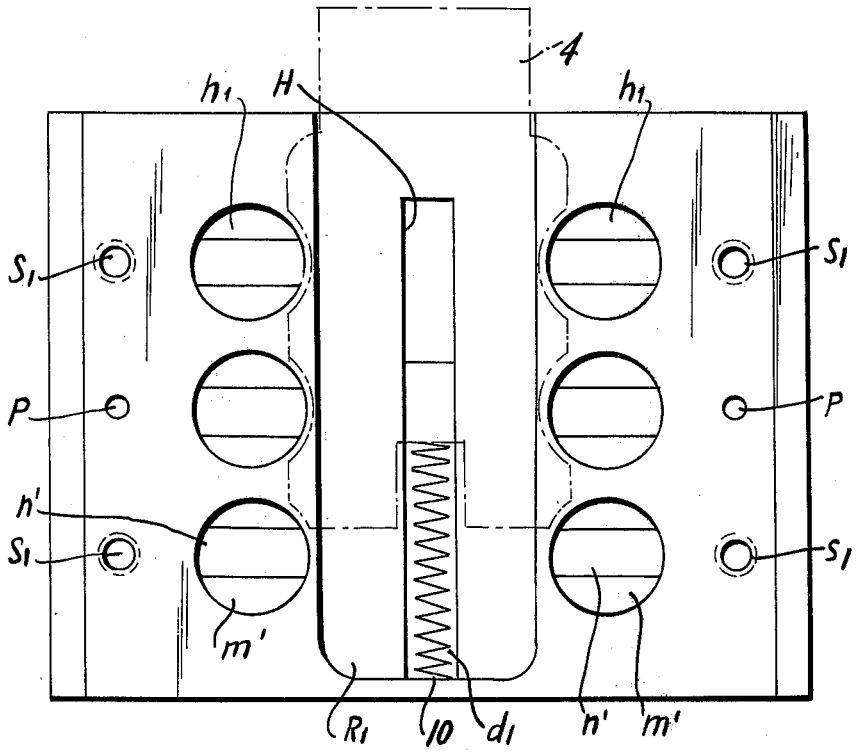
FIG. 5 is a rear elevation view of the front casing.

Referring to FIG. 5, a recess $R_1$ is formed on the rear surface of front casing 1, and forms part of the slot for accommodating and guiding lock plate 4. Extending centrally of this recess, through part of the length thereof, there is an elongated semi-circular groove $d_1$ which serves to receive a coil spring 10 biasing lock plate 4 to the locking position. The recess $d_1$ is aligned on the extended center line of the rectangular slot H.

Figure 8:
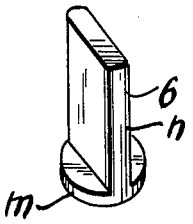
FIG. 8 is an oblique view of a push button.

In order to provide for push buttons 6 moving freely along push button bores $h_1$ but without springing out of these bores, push button bores $h_1$ are formed as circular cross-section bores having diametrically extending relatively narrow chord apertures $n'$ at their front ends, to allow only the chordal parts $n$, as shown in FIG. 8, of the associated push button to extend therethrough. The rearward parts $m'$ of the push button bores $h_1$ are drilled or formed slightly larger in diameter than the cylindrical portions of the push buttons 6. For proper assembly of the front and rear casing in correct alignment, front casing 1 is formed with two alignment pins $p$, one adjacent each edge of its rear surface. Front casing 1 is also formed with tapped bores $S_1$ for the screws S.

Figure 6:
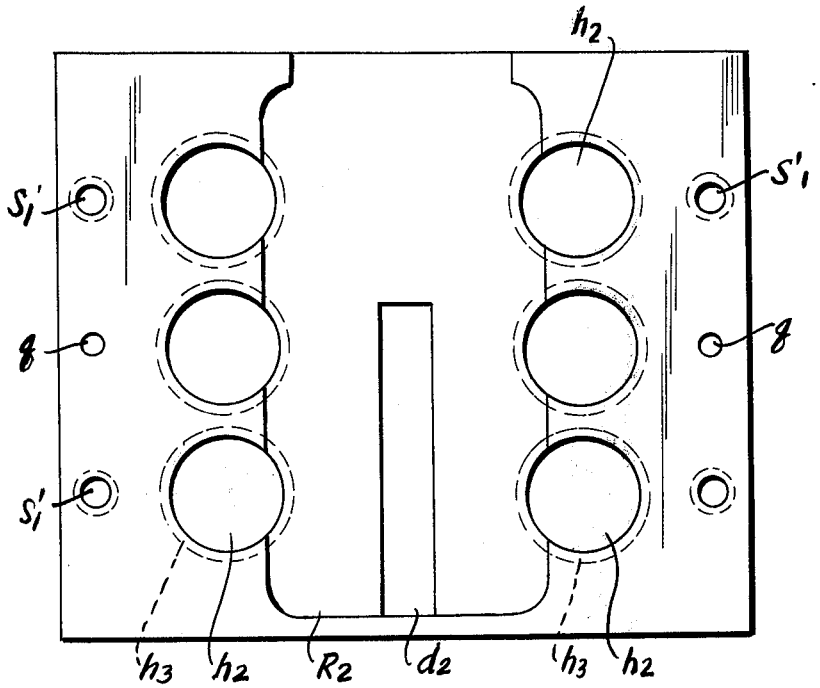
FIG. 6 is a rear elevation view of the rear casing.

Referring to FIG. 6, which shows the front or inner side of rear casing 2 and which will contact with the rear surface of front casing 1 after assembly of the two casing parts, in alignment with the recess $d_1$ in front casing 1, there is a corresponding semi-circular recess $d_2$ in the front face of the rear casing. Recess $d_2$ cooperates with recess $d_1$ to mount the return coil spring 10. In alignment with a substantially rectangular recess $R_1$ in front casing 1, there is a substantially rectangular recess $R_2$ in the front surface of rear casing 2 and which cooperates with the recess $R_1$ to form the slot accommodating lock plate 4.

In alignment with each push button bore $h_1$ in front casing 1, there is a respective push button bore $h_2$, having the same diameter as the associated bore $h_1$, drilled or otherwise formed in rear casing 2. The bores $h_2$ contain interlock blocks 7 described hereinafter. About ¼ of the cross-sectional area of each interlock block 7 overlaps lock plate 4 to prevent movement thereof. Circular recesses $h_3$, having a larger diameter than bores $h_2$, are formed concentric with the bores $h_2$ on the rear surface of rear casing 2 to accommodate flanges $f$ of the code changers 8. The bores $h_1$ and $h_2$, the associated circular recesses $h_3$, and circular openings $h_4$ in cover 3 are formed coaxially with each other. In addition, the front surface of the rear casing 2 is formed with holes $q$ to receive the alignment pin $p$, by which the front casing 1 and rear casing 2 can be assembled correctly. Rear casing 2 also is formed with tapped holes $S_1'$ for the screws S.

Figure 7:
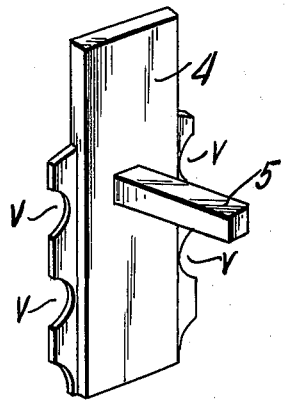
FIG. 7 is an oblique view of the lock plate and its manually actuable operating lever.

Referring to FIG. 7, which illustrates lock plate 4 in greater detail, the side edges of lock plate 4 are formed with a plurality of partial or complete semi-circular recesses or notches V, these notches having the same radius as the bores $h_2$, or a slightly larger radius than that of the bores $h_2$. When lock plate 4 is installed in the recess $R_2$ of rear casing 2, each notch V is engaged with a respective interlock block 7.

Figure 10:
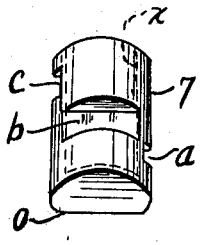
FIG. 10 is an oblique view of an interlock block.
Figure 11:
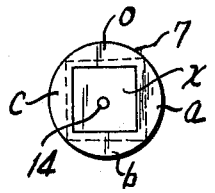
FIG. 11 is an end elevation view of an interlock block.

Interlock blocks 7 are installed loosely inside push button holes $h_2$ in rear casing 2. Referring to FIGS. 10 and 11, each interlock block is formed with a rectangular cross-section bore $x$ extending longitudinally and centrally thereof, and preferably having a square cross-section. In addition, each interlock block 7 is formed with four chordal slots or grooves $o$, $a$, $b$ and $c$ on its outer surface, the bases of these grooves extending perpendicular to each other. Each groove extends parallel to a side of the square bore $x$. Additionally, the four grooves are displaced, relative to each other, by 90°, so that groove $a$ extends perpendicular to groove $o$, groove $b$ extends perpendicular to groove $a$, and groove $c$ extends perpendicular to groove $b$. These chordal grooves are also spaced longitudinally from each other along interlock block 7, so that groove $o$ corresponds to "no push" of the associated push button, groove $a$ corresponds to a shallow push, groove $b$ to a medium push and groove $c$ to a deep push of the associated push button 6.

Figure 9:
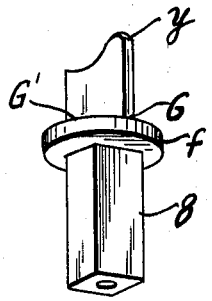
FIG. 9 is an oblique view of an interlock code changer.

Referring to FIG. 9, each code changer 8 includes three portions, namely a narrow rectangular head with a projection $y$, a flange $f$ and a square stem. Code changers 8 are used to change the angular positions of the associated interlock blocks 7, by virtue of the square stem thereof being inserted loosely into the square bore $x$ of the associated interlock block 7. A round bore is drilled centrally of each square stem to receive a coil spring 11, and the flange $f$ of each code changer 8 fits into the circular recess $h_3$ of the rear casing 2, with the rectangular narrow head, whose major lateral dimension is less than the diameter of flange $f$, projecting outwardly through the circular hole $h_4$ in rear cover 3. Thus, each code changer can be manually actuated to change the angular position of the associated interlock block 7.

Figure 12:
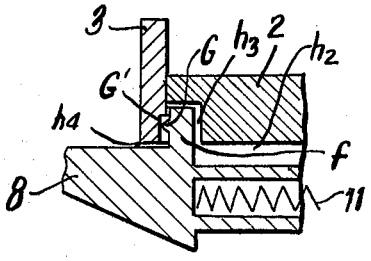
FIG. 12 is a partial sectional view illustrating the click means of a code changer engaged in a semi-spherical depression on the rear cover.

As shown in FIG. 12, in order to make it more convenient to set code changer 8 in each adjusted position, a click means is installed between the outer surface of flange $f$ and the inner surface of rear cover 3 adjacent aperture $h_4$ therein. The click means is so designed that there are four convex points G equiangularly distributed around the surface of flange $f$, and there are four semi-spherical depressions G', distributed correspondingly equiangular around the periphery of aperture $h_4$ on the inner surface of rear cover plate 3, and each corresponding to a position of a respective convex point G. The bias of spring 11 maintains the convex points G always engaged in the semi-spherical depressions G', so that code changer 8 can be set and releasably held firmly in a correct position without deviation from that position except when the code changer is manually actuated.

The main function of rear cover 3 is to hold code changers 8 in position and, through the use of screws S'', to secure the entire lock assembly to drawers, safes, or doors. As shown more particularly in FIG. 3, the circular holes $h_4$ in rear cover 3 make it possible for the narrow rectangular heads of code changers 8 to extend to the exterior of rear cover 3 for the user's convenience in manually turning the interlock code changers. Rear cover 3 is secured to rear casing 2 by flat head screws S' which are threadedly engaged in tapped holes in rear casing 2, as best seen in FIG. 4.

Referring further to FIG. 4, an elongated support pin 14 has one end fixed firmly in a central hole at the base of square recess $x$ in each code changer 7, and serves to maintain spring 11 rectilinear while it is being compressed. The return coil spring 10 shown in FIG. 5 is a compression spring having one end engaging the bottom of lock plate 4 and the other end engaging the end or the ends of the slots $d_1$ and $d_2$ for biasing lock plate 4 to the projected locking position.

OPERATION OF THE INVENTION

A. Unlocking the Lock

In order to permit lock plate 4 to move freely along its slot or groove in the casing assembly, the notches V on the opposite sides of lock plate 4 must not have the solid or unnotched portions of any interlock block engaged therein. This means that, without any of the push buttons 6 being depressed, the interlock blocks 7 should be so angularly oriented that their chordal grooves *o* have the opposite edges of lock plate 4 engaged therein. Such angular adjustment of the interlock blocks can be effected by the respective code changers 8. Under this condition, lock plate 4 can be moved between the locking and unlocking position by actuating operation lever 5 and by the bias of returning coil spring 10, without the necessity of operating any push buttons 6, all of which remain fully projected.

B. Locking the Lock

When any one or more of the interlock blocks 7 is angularly oriented so that a solid portion thereof is engaged in a notch V, rather than having a chordal groove thereof aligned with the adjacent side edge of lock plate 4, lock plate 4 cannot be moved from the projected or locking position unless the preset code is set up by depressing the push buttons 6.

C. Setting Different Combination Codes for Unlocking the Lock

With different angular positions of interlock blocks 7, the invention provides for a large number of combination codes for unlocking the lock. For example, with a lock having six push buttons as shown in FIG. 1, the lock has $4^6 = 4{,}096$ different possible combination codes to be chosen or selected. In other words, the multi-combination push button lock of the invention is the equivalent of 4,096 single combination locks.

Figure 3:
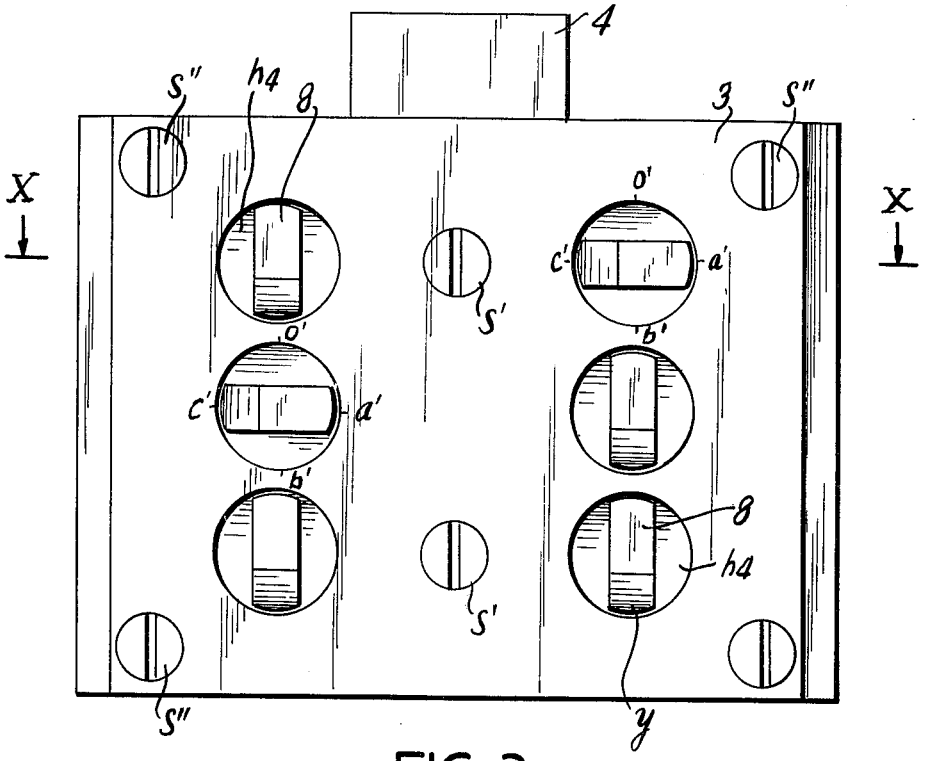
FIG. 3 is a rear view corresponding to FIG. 1.
Figure 4:
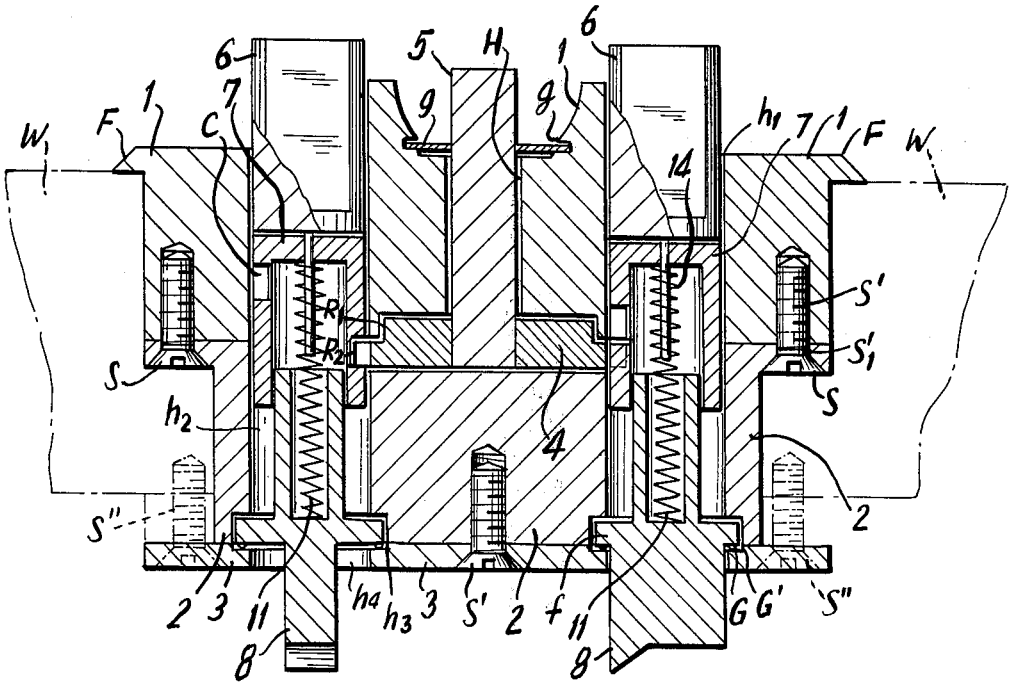
FIG. 4 is a cross-sectional view along the line X—X of FIG. 3 illustrating the arrangement of the interior mechanism.

Taking a simple example, if a code changer 8 has been set at position *a'*, as shown in FIG. 3, the corresponding groove *a* on the associated inner block 7 will face toward the lock plate 4, but will be longitudinally displaced from the lock plate 4 until the associated push button 6 is pushed inwardly to the first depth corresponding to a shallow push as determined by the land or rib $L_1$. This brings the associated slot *a* into alignment with notches V and, until this is effected, lock plate 4 cannot be moved to the unlocking position and will remain locked.

Similarly, assuming that one of the interlock blocks 7 has been set by its code changer 8 to the position *b'* of FIG. 3, unless the corresponding push button 6 is pushed to the second depth, or medium push, as determined by land or rib $L_2$, the lock cannot be unlocked. As a further example, and supposing that code changer 8 sets the associated interlock block 7 at the position *c'* of FIG. 3, unless the corresponding push button 6 is pushed to the "deep push" position, wherein it is flush with the outer surface of front casing 1, the lock cannot be unlocked.

Stated another way, if a code changer 8 is set at the position *a'*, the corresponding push button 6 must be pushed to the first depth $L_1$, if the code changer is set at position *b'*, the corresponding push button 6 must be pushed to the second depth $L_2$, and, if the code changer 8 is set at position *c'*, the corresponding push button 6 must be pushed down to the surface of front casing 1, or otherwise, the lock cannot be unlocked. Therefore, there are four positions at which each code changer 8 can be set, for example, the angular positions *o'*, *a'*, *b'* and *c'*. However, it is not necessary to push the associated push button at all when a code changer 8 is set at the position *o'*. Thus, if the code changers 8 are set at selected positions *a'*, *b'* and *c'* arbitrarily, the corresponding push button 6 must be pushed down to the proper respective depth simultaneously, or otherwise the lock cannot be unlocked.

As shown in FIG. 3, two code changers 8 are set at the position *c'*, namely the first one on the right side and the second one on the left side, so that, in this case, the associated two push buttons 6 should be pushed all the way down to the surface of front casing 1 simultaneously, or otherwise, the lock cannot be unlocked.

Figure 13:
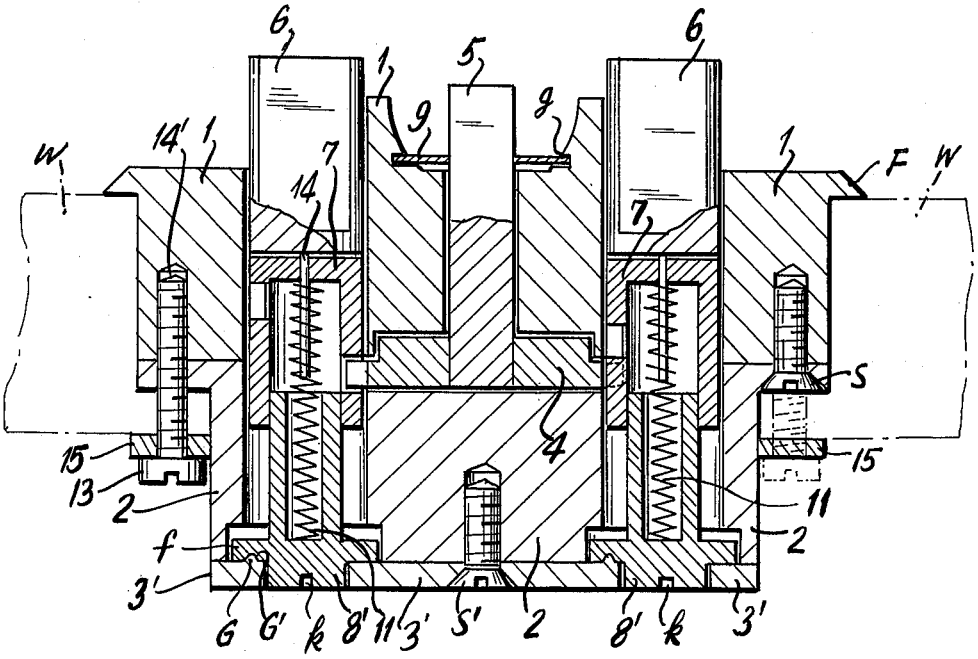
FIG. 13 is a view, similar to FIG. 4, of a modification of the lock shown in FIG. 1.

FIG. 13 illustrates a modification of the embodiment already described in which parts identical with those of the already described embodiment have been given the same reference character and further explanation will not be made. Those parts which are different or modified will now be explained.

Referring to FIG. 13, there is a modified rear cover 3' whose area is the same as that of the rear casing, and the four installation screw holes have been eliminated, but four installation screws 13 have been added. Also, there are four tapped holes 14' drilled into the rear side of front casing 1, for receiving screws 13 which anchor a retaining plate 15 to front casing 1. Additionally, the rectangular narrow heads of code changers 8' are modified to be decreased in length so as not to project outwardly of rear cover plate 3' but rather to be flush with the outer surface of the rear cover. The outer end of the head of each code changer 8' is formed with a slot or kerf *k* whereby the code changer can be angularly adjusted by a screwdriver to set or change the combination codes.

The click means is modified to the extent that, on the inner surface of rear cover 3', there are one or two pairs of symmetrical convex points G, and the outer surface of the flange of each code changer 8' is provided with four corresponding depressions G', the convex points and the depressions being equiangularly spaced from each other. Otherwise, the performance and operation of the modification of the invention shown in FIG. 3 is the same as that previously described. However, the modified form of the lock shown in FIG. 3 is easier to install on drawers, safes or doors of different thicknesses, and the end surfaces of code changers 8' are flat and flush with the outer surface of rear cover 3'. Thus, there is no possibility that the heads of the code changers can be hit or displaced by articles in the drawer so that their setting position is changed.

The special construction of the lock embodying the invention enables the user to change the combination code arbitrarily whenever he likes, so that the invention has a significant characteristic of high reliability and safety. The particularity of the invention is that, by turning the code changers 8 angularly to set the angular positions of the interlock blocks, the unlocked condition, or the combination codes for unlocking the lock, can be changed easily. Additionally, the user of the lock can push one or more than one of the push buttons on the front casing in accordance with the preset combination code to unlock the lock, so that it is not necessary to use any key.

The multi-combination push button lock forming the subject matter of the invention has been reduced to practice and, after a trial, the convenience of use, the reliability and the practical economy have been proven. These tests also prove that the lock forming the subject matter of the invention, as a practical matter, is a novel and revolutionary combination lock.

While specific embodiments of the invention have been shown and described in detail to illustrate the application of the principles of the invention, it will be understood that the invention may be embodied otherwise without departing from such principles.

What is claimed is:

1. A multi-combination push-button lock, with a plurality of preset positions, comprising, in combination, a front casing formed with a plurality of push-button bores therethrough each having a narrow chordal aperture adjacent the front surface of said front casing, the rear surface of said front casing being formed with a first rectangular recess having a first elongated semi-circular groove extending centrally thereof; a rear casing, fixed to said front casing, having a plurality of push-button assembly bores formed therethrough in alignment with said push-button bores of said front casing, and the surface of said rear casing facing said front casing being formed with a second rectangular recess having a second semi-circular groove extending centrally thereof, said first and second rectangular recesses defining a slot for a lock plate and said first and second semi-circular grooves defining a cylindrical recess for a return coil spring; a rear cover plate engaged with the outer surface of said rear casing and formed with circular apertures therethrough each aligned with a respective push-button assembly bore in said rear casing, said circular apertures providing access to code changers; a lock plate slidably mounted between said front and rear casing in said first and second rectangular recesses; a return coil spring disposed in said first and second semi-circular grooves and engaged with said lock plate and biasing said lock plate to its locking position; and a plurality of push-button assemblies each including a push-button, having an elongated chordal portion extending from a circular flange at its inner end, each push-button being mounted in a respective push-button bore, a cylindrical interlock block formed with four axially spaced chordal grooves in its outer periphery to provide four selective preset positions including shallow push, medium push, deep push and no push for the associated push button, each interlock block extending in a respective push-button bore and a respective push-button assembly bore aligned with the respective push-button bore, a code changer engaged with said interlock block and each disposed in a respective push-button assembly bore and having four angular setting positions corresponding to said four selective preset positions of the associated interlock block, for unlocking, and a respective coil spring engaged between each code changer and the associated interlock block and biasing the respective code changer toward the rear side and the respective interlock block and push-button conjointly toward the front side.

2. A multi-combination push-button lock, as claimed in claim 1, in which the outer surface of said front casing is formed with ribs projecting therefrom different distances and, together with the outer surface of said front casing, defining respective operated positions of said push-buttons.

3. A multi-combination push-button lock, as claimed in claim 2, in which each code changer has a polygonal inner end engaged in a polygonal bore in its associated interlock block; and detent means associated with each code changer and operable to releasably retain the code changer in a selected angular orientation.

4. A multi-combination push-button lock, as claimed in claim 3, in which the outer end of each code changer is formed with a narrow rectangular head projecting exteriorly of said rear cover.

5. A multi-combination push-button lock, as claimed in claim 3, in which the outer end of each code changer is flush with the outer surface of said rear plate and provided with a formation for engagement by a tool for angularly adjusting the code changers.

6. A multi-combination push-button lock comprising, in combination, lock casing means constructed for installation in a door, a drawer, and the like; a lock plate slidably mounted in said casing means for movement between a projected locking position and a retracted unlocking position; manually actuable operating means secured to said lock plate; a plurality of push-button assemblies mounted in said casing means and each including a push-button, an interlock block and a code changer; said interlock blocks being interengageable with said lock plate to prevent movement thereof by said operating means and being displaceable longitudinally, to release said lock plate, by simultaneous operation of said push-buttons in accordance with a preset combination code; said interlock blocks being angularly adjustable by said code changers to preset the combination code; said interlock blocks having equal numbers of longitudinally and angularly spaced formations each of which, when aligned with said lock plate, releases the interengagement of the associated interlock block and said lock plate; the longitudinal edges of said lock plate, considered in the direction of movement of said lock plate, being formed with arcuate recesses therein; said interlock blocks having a cylindrical cross-section and each interlock block extending through a respective arcuate recess; said formations comprising chordal slots in said interlock blocks having depths equal to those of said arcuate recesses; each interlock block having four longitudinally spaced chordal slots at angular spacings of 90°; said code changers being operable selectively to align a selected chordal slot to extend parallel to a longitudinal edge of said lock plate; said chordal slots being movable longitudinally into alignment with the longitudinal edges of said lock plate by simultaneous operation of said push-buttons in accordance with said preset combination code; said casing means comprising a front casing, a rear casing, and a rear cover plate; the facing surfaces of said front and rear casings being formed with aligned recesses conjointly defining an elongated slot in which said lock plate is slidably mounted; said front casing being formed with a narrow rectangular slot therein extending centrally of the recess therein; said operating means comprising a lever secured to said lock plate and engaged in said narrow rectangular slot through said front casing; said front and rear casings being formed with aligned bores therethrough each receiving a respective push-button assembly, with the respective push-buttons projecting forwardly of the outer surface of said front casing; said rear cover plate being formed with circular apertures therethrough each aligned with a respective push-button assembly receiving bore and providing access to said code changers; first spring means biasing said lock plate to its projected locking position; and second spring means each biasing a respective push-button to project outwardly of the front surface of said front casing, each push-button being formed with means limiting its outward projection; the outer surface of said front casing being formed with ribs projecting therefrom different distances and, together with the outer surface of said front casing, defining respective operated positions of said push-buttons.

7. A multi-combination push button lock, as claimed in claim 6, in which each code changer has a polygonal inner end engaged in a polygonal bore in its associated interlock block; and detent means associated with each code changer and operable to releasably retain the code changer in a selected angular orientation.

8. A multi-combination push button lock, as claimed in claim 7, in which the outer end of each code changer is formed with a narrow rectangular head projecting exteriorly of said rear cover.

9. A multi-combination push button lock, as claimed in claim 7, in which the outer end of each code changer is flush with the outer surface of said rear plate and provided with a formation for engagement by a tool for angularly adjusting the code changers.

* * * * *